US007255750B2

(12) United States Patent
Cartwright et al.

(10) Patent No.: US 7,255,750 B2
(45) Date of Patent: Aug. 14, 2007

(54) CLEANER WITH SOIL FLOCCULANT

(75) Inventors: Brian K. Cartwright, Pleasanton, CA (US); Maria Jaya, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 207 days.

(21) Appl. No.: 10/396,193

(22) Filed: Mar. 24, 2003

(65) Prior Publication Data

US 2005/0192199 A1 Sep. 1, 2005

(51) Int. Cl.

| | |
|---|---|
| ***B08B 3/04*** | (2006.01) |
| ***C11D 1/83*** | (2006.01) |
| ***C11D 1/88*** | (2006.01) |
| ***C11D 3/37*** | (2006.01) |

(52) U.S. Cl. ..... 134/42; 134/25.2; 134/25.3; 134/39; 134/40; 510/191; 510/197; 510/199; 510/214; 510/235; 510/238; 510/239; 510/240; 510/470; 510/475

(58) Field of Classification Search ..... 510/191, 510/197, 199, 214, 235, 238, 239, 240, 470, 510/475; 134/25.2, 25.3, 39, 40, 42
See application file for complete search history.

(56) References Cited

U.S. PATENT DOCUMENTS

| | | | | |
|---|---|---|---|---|
| 3,753,777 A | | 8/1973 | Thompsen et al. | 134/6 |
| 4,014,808 A | | 3/1977 | Herpers et al. | 252/135 |
| 4,820,450 A | * | 4/1989 | Wile et al. | 134/13 |
| 4,880,558 A | | 11/1989 | Jost et al. | 252/174.23 |

FOREIGN PATENT DOCUMENTS

| | | | |
|---|---|---|---|
| WO | WO 01/04248 | * | 1/2001 |
| WO | WO 01/23518 | * | 4/2001 |

* cited by examiner

*Primary Examiner*—Brian Mruk
(74) *Attorney, Agent, or Firm*—David Peterson

(57) ABSTRACT

The invention provides an improved dilutable cleaning composition for flocculating soil during use comprising a polymeric flocculation agent. In one embodiment, the composition optionally contains at least one adjunct selected from the group consisting of solvents, surfactants, cosurfactants, chelating agents, buffers, thickeners, dyes, colorants, biocides, fragrances, defoamers and mixtures thereof. The invention provides for settling of soil during use, resulting in a decrease in soil in the top of the use container.

20 Claims, No Drawings

CLEANER WITH SOIL FLOCCULANT

FIELD OF THE INVENTION

The present invention relates generally to hard and soft surface cleaners. More particularly, the present invention relates to a dilutable cleaner composition that causes soil to flocculate as the soil contaminates the diluted cleaner solution.

BACKGROUND OF THE INVENTION

For many cleaning applications, especially dilutable cleaning applications, a mop, sponge or other cleaning device is repeatedly dipped into the cleaning solution for both rinsing and gathering up more cleaning solution. The mop, sponge or other cleaning device may become contaminated with the dirty cleaning solution during use. It would be an advantage if the soil contamination in the cleaning solution would separate from the remaining of the cleaning solution in a fast and efficient manner.

U.S. Pat. No. 4,820,450 to Wile and Middien discloses the use of the combination of a water soluble polyamine or polyacrylamide flocculant and phosphobetaine stabilizer in at least 1% concentration. U.S. Pat. No. 4,014,808 to Herpers and Untiedt discloses a detergent composition, which includes a flocculant for effecting coagulation of soilage present on a soiled floor surface. U.S. Pat. No. 4,880,558 to Jost and Wisotzki disclose certain polymers and specific nonionics to increase soil suspending power.

It is therefore an object of the present invention to provide an improved cleaner composition that overcomes the aforementioned drawbacks and disadvantages that are often associated with conventional cleaner compositions.

SUMMARY OF THE INVENTION

In accordance with the above objects and those that will be mentioned and will become apparent below, the dilutable cleaning composition for hard or soft surfaces in accordance with this invention comprises:

a. a polymer which causes soil to flocculate when the composition is diluted and used with water in a ratio of 1:10 to 1:100 of the composition to water;
b. optionally, at least one adjunct selected from the group consisting of solvents, surfactants, cosurfactants, chelating agents, buffers, thickeners, dyes, colorants, biocides, fragrances, defoamers and mixtures thereof; and
c. the remainder, water.

In additional embodiments of the invention, the dilutable cleaning composition has a turbidity under simulated use conditions of less than 50 NTU.

In additional embodiments, the invention provides a method for cleaning hard or soft surfaces comprising:

a. diluting a cleaning composition with water in a ratio of 1:10 to 1:100 of the composition to water;
b. said composition comprising:
   i. a polymer which causes soil to flocculate when the composition is diluted and used with water in a ratio of 1:10 to 1:100 of the composition to water;
   ii. optionally, at least one adjunct selected from the group consisting of solvents, surfactants, cosurfactants, chelating agents, buffers, thickeners, dyes, colorants, biocides, fragrances, defoamers and mixtures thereof; and
   iii. the remainder, water.

In additional embodiments, the invention provides an article of manufacture comprising a concentrated composition in a package in association with instructions to use the composition to form a dilute solution to clean hard surfaces.

In all of the lists of components herein, if an ingredient can be classified in more than one place, it will be classified in the first place it can appear.

DETAILED DESCRIPTION OF THE INVENTION

Before describing the present invention in detail, it is to be understood that this invention is not limited to particularly exemplified systems or process parameters as such may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As will be appreciated by one having ordinary skill in the art, the cleaner composition of the invention substantially reduces or eliminates the disadvantages and drawbacks associated with prior art cleaner compositions. In one embodiment of the invention, the cleaner composition includes at least one flocculation polymer. In additional embodiments of the invention, the noted cleaner composition also includes a supplemental flocculation agent, a surfactant, solvent, anti-bacterial agent and/or a fragrance. Each of the noted cleaner composition components is discussed in detail below. In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition.

The term flocculation, as used herein, is synonymous with the term coagulation. Flocculation refers to the enhanced settling of suspended solid particles from aqueous systems. Turbidity, as used herein, is defined as the cloudiness or haziness of a solution caused by finely suspended particles. Turbidity is measured using NTU's, (nephelometric turbidity units).

Flocculation Polymer

The following patents provide examples of suitable flocculation polymers and are incorporated by reference. U.S. Pat. No. 5,182,331 teaches treatment of wastewater utilizing a block copolymer containing a polymeric segment obtained from polymerization of hydrophobic or water insoluble monomers attached to a polymer chain obtained from polymerization of one or more water soluble monomers. U.S. Pat. No. 4,906,716 discloses a process of incorporating hydrophobic water insoluble monomers, such as alkyl acrylamides which are solid at room temperature, with acrylamide into a water soluble copolymer. U.S. Pat. No. 4,835,234 discloses hydrophobically associating terpolymers containing acrylamide, cationic monomer and water insoluble monomers such as higher alkylacrylate or alkylamide. U.S. Pat. No. 5,368,744 discloses polymers for flocculating oily wastewater. U.S. Pat. No. 5,213,693 discloses dewatering flocculants. U.S. Pat. No. 5,185,083 describes modified amine polymers for flocculation. U.S. Pat. No. 3,692,673 discloses the use of polymers of 2-acrylamido-2-methylpropyl sulfonic acid and their salts as flocculants particularly for use in clarification of surface water and municipal sewage. U.S. Pat. No. 6,361,652 describes a method of increasing drainage in papermaking. Cationic or amphoteric starches useful in the application of this invention are generally described in U.S. Pat. No. 4,385,961.

The polymer must be substantially water soluble or dispersible and is preferably substantially linear. The monomers from which it is formed are preferably substantially free of crosslinking agent. It may be based on a natural or modified natural polymer. For instance, it may be a cellulosic or gum polymer such as a cationic or other ionic derivative of a cellulose or an ionic derivative of guar gum.

Preferably, the polymer is a substantially linear synthetic polymer formed by polymerisation of one or more ethylenic, preferably vinyl, water soluble monomers. Any monomer or monomer blend that can be polymerised to yield a water soluble flocculant polymer may be used. The monomers are generally acrylic (including methacrylic) monomers. The polymer may be non-ionic, being formed wholly from non-ionic monomers, but preferably is ionic since even non-ionic monomers generally include some ionic groups, for instance acrylic acid groups are often present in acrylamide. The amount and type of ionic charge in the monomers will be selected such that the polymer has the ionic charge suitable for the particular formulation desired.

Suitable non-ionic monomers are acrylamide, methacrylamide, N- vinylmethylacetamide or formamide, vinyl acetate, acrylate and methacrylate esters, and vinyl pyrrolidone. Suitable anionic monomers are sodium acrylate, methacrylate, itaconate, 2-acrylamidomethyl propane sulphonate, sulphopropylacrylate or methacrylate or other water soluble forms of these or other polymerisable carboxylic or sulphonic acids or sulphomethylated acrylamide.

Suitable cationic monomers are dialkylaminoalkyl acrylates and methacrylates, especially dialkylaminoethyl acrylate, and their quaternary or acid salts, and dialkylaminoalkylacrylamides and methacrylamides and their quaternary or acid salts for instance methacrylamidopropyl trimethyl ammonium chloride and Mannich products, such as quaternised dialkylamino methylacrylamides. Other suitable monomers include diallyldimethyl ammonium chloride, especially when copolymerised with acrylamide, and vinyl pyridine (as acid addition or quaternary salt) and Hoffman degradation products such as polyvinylamine. Other typical quaternary amine cationic monomers include: 1-trimethylammonium-2-hydroxypropylmethacrylate methosulfate, trimethylammonium-2-hydroxypropylacrylate methosulfate, 1-trimethylammonium-2-2-hydroxypropylacrylate methosulfate, 3-methacrylamidopropyltrimethylammonium chloride, dimethylaminoethylmethacrylate methylchloride quat, and the like. For cationic flocculants, the repeating monomer units of the polymer will include anywhere from 1-70 mole % of the cationic monomer with the remainder being a nonionic substrate such as: acrylamide, methacrylamide, N-methyl acrylamide, N-methylmethacrylamide and the like.

A substantially non-ionic polymer flocculant may be slightly ionic, for instance comprising no more than 10 mole % ionic repeating units. Thus the polymer may contain up to 10 mole % anionic groups or up to 10 mole % cationic groups. It may also be desirable for the substantially non-ionic polymer to comprise both anionic and cationic groups provided that the effective ionic charge is less than 10 mole %.

When a substantially non-ionic polymer does comprise ionic groups, it may be as a result of copolymerising a non-ionic monomer with low amounts of ionic monomer, for instance up to 10 mole %. Alternatively, the polymer may prepared using a non-ionic monomer that is capable of being converted into an ionic monomer. In this instance, a non-ionic monomer may polymerised and either during the polymerization process or subsequently up to 10 mole % of the non-ionic monomer units would be converted into ionic groups. For instance, the nonionic monomer may be acrylamide up to 10 mole % of the acrylamide repeating units may be hydrolysed to acrylic acid units.

Although a substantially non-ionic polymer can be slightly ionic it is preferred that the ionic content is below 5%. More preferably, the polymer is wholly non-ionic or contains no more than 2 mole % ionic content.

A non-ionic polymer is desirably prepared predominately from non-ionic water soluble ethylenically unsaturated monomers. By water soluble, we mean that the monomer has a solubility of at least 5 g/100 ml at 25° C. A minor amount of non-water soluble monomers may also be included. Such polymers may be prepared by any of the standard industrial processes for making polymers, for instance by solution polymerization, reverse phase suspension polymerization or reverse phase emulsion polymerization. The non-ionic polymer thus may be provided in the form of beads, powder or emulsions. Typically the non-ionic polymer is selected from the group consisting of polymers of acrylamide, polyvinyl pyrrolidone and polyethylene oxide. The non-ionic polymers are generally of relatively high molecular weight, for instance above 500,000. Desirably, the molecular weight is in excess of 1,000,000 and typically several million, for instance, at least 2,000,000 to 4,000,000 and optionally 10,000,000 or higher.

Optionally, the flocculant can be a cationic polymer, generally copolymers of a cationic monomer and acrylamide, usually 20 to 90% by weight acrylamide. One example is a co-polymer containing 70 wt % acrylamide and 30 wt % quaternary ammonium salt of dimethyl amino ethyl acrylate. Optionally, the flocculant can be various other cationic organic polymers, including but not limited to poly(alkaline amines), poly(diallyl dimethyl ammonium chloride), poly(2-hydroxy propyl-1-N-methyl ammonium chlorides) and quaterized poly(N-N-dimethylaminomethacrylate). Other preferred polymers are polydimethyl diallyl ammonium chloride (polyDMDAAC), polydiethyldiallyl ammonium chloride (polyDEDAAC), polydimethyl diallyl ammonium bromide (polyDMDAAB) and polydiethyl diallyl ammonium bromide (polyDEDAAB). One preferred dialkyl diallyl ammonium polymer is a homo polymer or dimethyl diallyl ammonium chloride. The molecular weight of the dialkyldiallyl ammonium polymer preferably ranges from about 1,000 to about 5,000,000, as determined by gel permeation chromatography. Other optional polyamines are epichlorohydrin-dimethylamine polymers. For substantially cationic polymers, molecular weights ranging from about 500 to about 5,000,000, as determined by gel permeation chromatography, are preferred.

Preferred polymers include anionic and nonionic polyacrylamides from Hychem, Inc. sold under the tradenames AF306, AF306HH, AF308, AF308HH, NF301, AE853, AE873, and NE823. These polymers are generally above 12,000,000 molecular weight and vary for high charged to very slightly charged. Other preferred polymers include anionic polyacrylamides that are copolymers of acrylamide and sodium or potassium acrylate. Preferred anionic polymers from SNF Floerger include AN905SH, AN934SH, AN905Std, AN905MPM, AN905BPM, AN905VLM, and FloGel 509 (an anionic polyacrylamide with sodium acrylate and molecular weight from 5-7,000,000. Some of these polymers have a molecular weight in the range of 1-5,000,000 molecular weight. Other preferred polymers include cationic polyacrylamides from SNF Floerger sold under tradenames FO4190, FO4350, FO4490, and FO4700. These polymers are generally above 5,000,000 molecular weight. Other preferred polymers include cationic polyacrylamides that are copolymers of acrylamide and dimethylaminoethyl acrylates or quaternary derivatives. Other preferred acrylamide copolymers are available from Ciba Specialty Chemicals. Preferred polymers also include polyethylene oxide polymers from Dow Chemical, including Polyox WSR-301, Polyox WSR-308, Polyox WSR N-12K, Polyox WSR N-60K, and Ucarfloc 309. These polymers are generally from 1-10,000,000 molecular weight.

Other polymers that may be used include polyethyleneimines, such as Lupasol PS and Lupasol SK from BASF, and diallyldimethylammonium chloride and copolymers, such as CP 625, CP 626, and CP 627 from Hychem. Other polymers that may be used include polyvinylamine, such as Lupasol LU321 from BASF. Other polymers that may be used include Versa TL-501, Flocaid 19 and Flocaid 34 from Alco. These polymers vary in molecular weight from 200,000 to 2,000,000 and above.

Supplemental Flocculation Agent

The composition may also contain a supplemental flocculation agent that increases the flocculation provided by the flocculation polymer. These include inorganic salts such as Additional agents include aluminum salts such as aluminum sulfate, aluminum chloride hydroxide, sodium aluminate, and aluminum silicate.

Surfactant

The components in accord with the invention and the compositions herein preferably contain one or more surfactants selected from anionic, nonionic, cationic, ampholytic, amphoteric and zwitterionic surfactants and mixtures thereof. A typical listing of anionic, nonionic, ampholytic, and zwitterionic classes, and species of these surfactants, is given in U.S. Pat. No. 3,929,678 to Laughlin and Heuring. Further examples are given in "Surface Active Agents and Detergents" (Vol. I by Schwartz, Perry and Berch). A list of suitable cationic surfactants is given in U.S. Pat. No. 4,259,217 to Murphy. Where present, ampholytic, amphotenic and zwitteronic surfactants are generally used in combination with one or more anionic and/or nonionic surfactants.

The components in accord with the present invention and/or the detergent compositions herein may comprise an anionic surfactant. Essentially any anionic surfactants useful for detersive purposes can be comprised in the detergent composition. These can include salts (including, for example, sodium, potassium, ammonium, and substituted ammonium salts such as mono-, di- and triiethanolamine salts) of the anionic sulfate, sulfonate, carboxylate and sarcosinate surfactants. Anionic sulfate and sulfonate surfactants are preferred. The anionic surfactants are preferably present at a level of from 0% to 60%, more preferably from 0.5% to 10%, most preferably from 1% to 5% by weight. Preferred are surfactants systems comprising a sulfonate and a sulfate surfactant, preferably a linear or branched alkyl benzene sulfonate and alkyl ethoxysulfates, as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated C12-C18 monoesters) diesters of sulfosuccinate (especially saturated and unsaturated C6-C14 diesters), N-acyl sarcosinates. Resin acids and hydrogenated resin acids are also suitable, such as rosin, hydrogenated rosin, and resin acids and hydrogenated resin acids present in or derived from tallow oil. Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the C5-C17acyl-N—(C1-C4 alkyl) and —N—(C1-C2 hydroxyalkyl) glucamine sulfates, and sulfates of alkylpolysacchanides such as the sulfates of alkylpolyglucoside (the nonionic nonsulfated compounds being described herein). Alkyl sulfate surfactants are preferably selected from the linear and branched primary C10-C18 alkyl sulfates, more preferably the C11-C15 branched chain alkyl sulfates and the C12-C14 linear chain alkyl sulfates.

Alkyl ethoxysulfate surfactants are preferably selected from the group consisting of the C10-C18 alkyl sulfates which have been ethoxylated with from 0.5 to 20 moles of ethylene oxide per molecule. More preferably, the alkyl ethoxysulfate surfactant is a C11-C18, most preferably C11-C15 alkyl sulfate which has been ethoxylated with from 0.5 to 7, preferably from 1 to 5, moles of ethylene oxide per molecule. A particularly preferred aspect of the invention employs mixtures of the preferred alkyl sulfate and/or sulfonate and alkyl ethoxysulfate surfactants. Such mixtures have been disclosed in PCT Patent Application No. WO 93/18124.

Anionic sulfonate surfactants suitable for use herein include the salts of C5-C20 linear alkylbenzene sulfonates, alkyl ester sulfonates, C6-C22 primary or secondary alkane sulfonates, C6-C24 olefin sulfonates, sulfonated polycarboxylic acids, alkyl glycerol sulfonates, fatty acyl glycerol sulfonates, fatty oleyl glycerol sulfonates, and any mixtures thereof. Suitable anionic carboxylate surfactants include the alkyl ethoxy carboxylates, the alkyl polyethoxy polycarboxylate surfactants and the soaps ('alkyl carboxyls'), especially certain secondary soaps as described herein. Suitable alkyl ethoxy carboxylates include those with the formula RO(CH2CH20)x CH2C00 $^{-}M^{+}$ wherein R is a C6 to C18 alkyl group, x ranges from 0 to 10, and the ethoxylate distribution is such that, on a weight basis, the amount of material where x is 0 is less than 20% and M is a cation. Suitable alkyl polyethoxypolycarboxylate surfactants include those having the formula RO—(CHR$^{1}$—CHR$^{2}$-0)-R$^{3}$ wherein R is a C6 to C18 alkyl group, x is from 1 to 25, R$^{1}$ and R$^{2}$ are selected from the group consisting of hydrogen, methyl acid radical, succinic acid radical, hydroxysuccinic acid radical, and mixtures thereof, and R$^{3}$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-solubie salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Other suitable anionic surfactants are the alkali metal sarcosinates of formula R—CON ($R^1$) CH—)COOM, wherein R is a C5-C17 linear or branched alkyl or alkenyl group, $R^1$ is a C1-C4 alkyl group and M is an alkali metal ion. Preferred examples are the myristyl and oleoyl methyl sarcosinates in the form of their sodium salts.

Essentially any alkoxylated nonionic surfactants are suitable herein. The ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Polyhydroxy fatty acid amides suitable for use herein are those having the structural formula $R^2CONR^1Z$ wherein: $R^1$ is H, C1-C4 hydrocarbyl, 2-hydroxyethyl, 2-hydroxypropyl, ethoxy, propoxy, or a mixture thereof, preferable C1-C4-alkyl, more preferably C1 or C2 alkyl, most preferably C1 alkyl (i.e., methyl); and $R^2$ is a C5-C31 hydrocarbyl, preferably straight-chain C5-C19 alkyl or alkenyl, more preferably straight-chain C9-C17 alkyl or alkenyl, most preferably straight-chain C11-C17 alkyl or alkenyl, or mixture thereof-, and Z is a polyhydroxyhydrocarbyl having a linear hydrocarbyl chain with at least 3 hydroxyls directly connected to the chain, or an alkoxylated derivative (preferably ethoxylated or propoxylated) thereof Z preferably will be derived from a reducing sugar in a reductive amination reaction; more preferably Z is a glycityl.

Suitable fatty acid amide surfactants include those having the formula: $R^1$ CON($R^2$)2 wherein $R^1$ is an alkyl group containing from 7 to 21, preferably from 9 to 17 carbon atoms and each $R^2$ is selected from the group consisting of hydrogen, C1-C4 alkyl, C1-C4 hydroxyalkyl, and —(C2H40)xH, where x is in the range of from 1 to 3.

Suitable alkylpolysaccharides for use herein are disclosed in U.S. Pat. No. 4,565,647 to Llenado, having a hydrophobic group containing from 6 to 30 carbon atoms and a polysaccharide, e.g., a polyglycoside, hydrophilic group containing from 1.3 to 10 saccharide units. Preferred alkylpolyglycosides have the formula: $R^2$O(CnH2nO)t(glycosyl)x wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

The nonionic surfactants are preferably present at a level of from 0% to 60%, more preferably from 0.5% to 10%, most preferably from 1% to 5% by weight.

Suitable amphoteric surfactants for use herein include the amine oxide surfactants and the alkyl amphocarboxylic acids. Suitable amine oxides include those compounds having the formula $R^3(OR^4)_xNO(R^5)2$ wherein $R^3$ is selected from an alkyl, hydroxyalkyl, acylamidopropyl and alkylphenyl group, or mixtures thereof, containing from 8 to 26 carbon atoms; $R^4$ is an alkylene or hydroxyalkylene group containing from 2 to 3 carbon atoms, or mixtures thereof-, x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are C10-C18 alkyl dimethylamine oxide, and C10-18 acylamido alkyl dimethylamine oxide. A suitable example of an alkyl amphodicarboxylic acid is Miranol(™) C2M Conc. manufactured by Miranol, Inc., Dayton, N.J.

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphoniurn or tertiary sulfonium compounds. Betaine and sultaine surfactants are exemplary zwittenionic surfactants for use herein.

Suitable betaines are those compounds having the formula $R(R^1)_2N^+R^2COO^-$ wherein R is a C6-C18 hydrocarbyl. group, each $R^1$ is typically C1-C3 alkyl, and $R^2$ is a C1-C5 hydrocarbyl group. Preferred betaines are C12-18 dimethylammonio hexanoate and the C10-18 acylamidopropane (or ethane) dimethyl (or diethyl) betaines. Complex betaine surfactants are also suitable for use herein.

The amphoteric and zwitterionic surfactants are preferably present at a level of from 0% to 60%, more preferably from 0.5% to 10%, most preferably from 1% to 5% by weight.

Suitable cationic surfactants to be used herein include the quaternary ammonium surfactants. Preferably the quaternary ammonium surfactant is a mono C6-C16, preferably C6-C10 N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants. The cationic ester surfactant is a, preferably water dispersible, compound having surfactant properties comprising at least one ester (i.e. —COO—) linkage and at least one cationically charged group. Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting, of carbon, nitrogen and oxygen atoms and any mixtures thereof, with the proviso that any nitrogen or oxygen atom in said chain connects only with carbon atoms in the chain. Thus spacer groups having, for example, -0-0- (i.e. peroxide), —N—N—, and —N-0- linkages are excluded, whilst spacer groups having, for example —CH2-0- CH2- and —CH2-NH—CH2- linkages are included. In a preferred aspect the spacer group chain comprises only carbon atoms, most preferably the chain is a hydrocarbyl chain.

Highly preferred herein are cationic mono-alkoxylated amine surfactants preferably of the general formula: $R^1R^2R^3N^+ApR^4\ X^-$ wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8. Preferably the $ApR^4$ group in the formula has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are —CH2CH2-10H, —CH2CH2CH2-0H, —CH2CH(CH3)-OH and —CH(CH3)CH2-OH, with —CH2CH2-OH being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula $R^1(CH3)(CH3)N^+(CH2CH20)_{2\text{-}5}H\ X^-$ wherein $R^1$ is C10-C18 hydrocarbyl and mixtures thereof, especially C10-C14 alkyl, preferably C10 and C12 alkyl, and X is any convenient anion to provide charge balance, preferably chloride or bromide.

As noted, compounds of the foregoing type include those wherein the ethoxy (CH2CH2O) units (EO) are replaced by butoxy, isopropoxy [CH(CH3)CH2O] and [CH2CH(CH3)O] units (i-Pr) or n-propoxy units (Pr), or mixtures of EO and/or Pr and/or i-Pr units.

The cationic bis-alkoxylated amine surfactant preferably has the general formula: $R^1R^2N^+ApR^3A'qR^4\ X^-$ wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from C1-C4 alkoxy, especially ethoxy, (i.e., —CH2CH2O—), propoxy, butoxy and mixtures thereof, p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula $R^1CH3N^+(CH2CH2OH)(CH2CH2OH)\ X^-$ wherein $R^1$ is C10-C18 hydrocarbyl and mixtures thereof, preferably C10, C12, C14 alkyl and mixtures thereof $X^-$ is any convenient anion to provide charge balance, preferably chloride. With reference to the general cationic bis-alkoxylated amine structure noted above, since in a preferred compound $R^1$ is derived from (coconut) C12-C14 alkyl fraction fatty acids, $R^2$ is methyl and $ApR^3$ and $A'qR^4$ are each monoethoxy.

Other cationic bis-alkoxylated amine surfactants useful herein include compounds of the formula: $R^1R^2N^+$—$(CH2CH2O)_pH$—$(CH2CH2O)_qH\ X^-$ wherein $R^1$ is C10-C18 hydrocarbyl, preferably C10-C14 alkyl, independently p is 1 to about 3 and q is 1 to about 3, $R^2$ is C1-C3 alkyl, preferably methyl, and $X^-$ is an anion, especially chloride or bromide.

Other compounds of the foregoing type include those wherein the ethoxy (CH2CH2O) units (EO) are replaced by butoxy (Bu) isopropoxy [CH(CH3)CH2O] and [CH2CH(CH3)O] units (i-Pr) or n-propoxy units (Pr), or mixtures of EO and/or Pr and/or i-Pr units.

The cationic surfactants are preferably present at a level of from 0% to 60%, more preferably from 0.5% to 10%, most preferably from 1% to 5% by weight.

Solvent

Suitable solvents include, but are not limited to, $C_{1\text{-}6}$ alkanols, $C_{1\text{-}6}$ diols, $C_{1\text{-}10}$ alkyl ethers of alkylene glycols, $C_{3\text{-}24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols, Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water soluble solvent when employed.

The solvents are preferably present at a level of from 0% to 60%, more preferably from 0.5% to 10%, most preferably from 1% to 5% by weight.

Additional Adjuncts

The cleaning compositions optionally contain one or more of the following adjuncts: blooming agents, stain blocking agents, stain and soil repellants, enzymes, lubricants, insecticides, miticides, anti-allergen agents, odor control agents, perfumes, fragrances and fragrance release agents, brighteners or fluorescent whitening agents, oxidizing or reducing agents, and polymers which leave a film to trap or adsorb bacteria, virus, mite, allergens, dirt, dust, or oil. Other adjuncts include, but are not limited to, acids, electrolytes, waxes, dyes and/or colorants, solubilizing materials, stabilizers, thickeners, defoamers, hydrotropes, lotions and/or mineral oils, bleaching agents, cloud point modifiers, preservatives, and other polymers. The solubilizing materials, when used, include, but are not limited to, hydrotropes (e.g. water soluble salts of low molecular weight organic acids such as the sodium and/or potassium salts of toluene, cumene, and xylene sulfonic acid). The acids, when used, include, but are not limited to, organic hydroxy acids, citric acids, keto acid, and the like. Electrolytes, when used, include, calcium, sodium and potassium chloride. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. Enzymes, when used, include, but are not limited to, lipases and proteases. Bleaching agents, when used, include, but are not limited to, peracids, hypohalite sources, hydrogen peroxide, and/or sources of hydrogen peroxide.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard and/or Glydant) and/or short chain alcohols (e.g. ethanol and/or IPA). The mildewstat or bacteriostat includes, but is not limited to, mildewstats (including non-isothiazolone compounds) include Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1, 3 diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G.

Antimicrobial Agent

An antimicrobial agent can also be included in the cleaning composition. Non-limiting examples of useful quaternary compounds that function as antimicrobial agents include benzalkonium chlorides and/or substituted benzalkonium chlorides, di($C_6$-$C_{14}$)alkyl di short chain ($C_{1-4}$ alkyl and/or hydroxyalkl) quaternaryammonium salts, N-(3-chloroallyl) hexaminium chlorides, benzethonium chloride, methylbenzethonium chloride, and cetylpyridinium chloride. The quaternary compounds useful as cationic antimicrobial actives are preferably selected from the group consisting of dialkyldimethyl ammonium chlorides, alkyl dimethylbenzylammonium chlorides, dialkylmethylbenzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are preferred. Typical concentrations for biocidal effectiveness of these quaternary compounds, especially in the preferred low-surfactant compositions herein, range from about 0.001% to about 10% and preferably from about 0.5% to about 3% of the usage composition. The weight percentage ranges for the biguanide and/or quat compounds in the cleaning composition is selected to disinfect, sanitize, and/or sterilize most common household and industrial surfaces.

Non-quaternary biocides are also useful in the present compositions. Such biocides can include, but are not limited to, alcohols, peroxides, boric acid and borates, chlorinated hydrocarbons, organometallics, halogen-releasing compounds, mercury compounds, metallic salts, pine oil, organic sulfur compounds, iodine compounds, silver nitrate, quaternary phosphate compounds, and phenolics.

These antimicrobial, antifungal or antiallergen agents include water-soluble, film-forming polymers (See, Ochomogo et al., U.S. Pat. No. 6,454,876, incorporated herein by reference), quaternary ammonium compounds and complexes therewith (See Zhou et al., U.S. Pat. Nos. 6,482,392, 6,080,387, 6,284,723, 6,270,754, 6,017,561 and 6,013,615, all of which are incorporated herein by reference), essential oils, such as nerolidol (See Shaheen et al, U.S. Pat. No. 6,361,787, incorporated by reference), Kathon (See, Sells et al., U.S. Pat. No. 5,789,364 and Koerner et al., U.S. Pat. No. 5,589,448 incorporated by reference), and, possibly, bleaches, such as hydrogen peroxide and alkali metal hypochlorite.

Builder/Buffer

The cleaning composition may include a builder or buffer, which increase the effectiveness of the surfactant. The builder or buffer can also function as a softener and/or a sequestering agent in the cleaning composition. A variety of builders or buffers can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives.

Builders or buffers can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builders or buffers can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are tri(hydroxymethyl) amino methane (TRIS), 2-amino-2-ethyl-1,3-propanediol, 2-amino-2-methyl- propanol, 2-amino-2-methyl-1,3-propanol, disodium glutamate, N-methyl diethanolarnide, 2-dimethylamino-2-methylpropanol (DMAMP), 1,3-bis(methylamine)-cyclohexane, 1,3-diamino-propanol N,N'- tetra-methyl-1,3-diamino-2-propanol, N,N-bis(2-hydroxyethyl)glycine (bicine) and N-tris (hydroxymethyl)methyl glycine (tricine). Other suitable buffers include ammonium carbamate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see McCutcheon's *Emulsifiers and Detergents*, North American Edition, 1997, McCutcheon Division, MC Publishing Company Kirk and WO 95/07971, both of which are incorporated herein by reference.

When employed, the builder or buffer comprises at least about 0.001% and typically about 0.01-25% of the cleaning composition. Preferably, the builder or buffer content is about 0.01-2%.

Pine Oil, Terpene Derivatives and Essential Oils

Compositions according to the invention may comprise pine oil, terpene derivatives and/or essential oils. Pine oil, terpene derivatives and essential oils are used primarily for cleaning efficacy. They may also provide some antimicrobial efficacy, deodorizing properties, and blooming properties on dilution.

Pine oil is a complex blend of oils, alcohols, acids, esters, aldehydes and other organic compounds. These include terpenes which include a large number of related alcohols or ketones. Some important constituents include terpineol. One type of pine oil, synthetic pine oil, will generally contain a higher content of turpentine alcohols than the two other grades of pine oil, namely steam distilled and sulfate pine oils. Other important compounds include alpha- and beta-pinene (turpentine), abietic acid (rosin), and other isoprene derivatives. Particularly effective pine oils are commercially available from Mellennium Chemicals, under the Glidco tradename. These pine oils vary in the amount of terpene alcohols and alpha-terpineol. The pine oil constituent may be present in the concentrate compositions in amounts of up to about 25% by weight, preferably in amounts of 0.1 and 15% by weight.

Terpene derivatives appropriate for use in the inventive composition include terpene hydrocarbons having a functional group, such as terpene alcohols, terpene ethers, terpene esters, terpene aldehydes and terpene ketones. Examples of suitable terpene alcohols include verbenol, transpinocarveol, cis-2-pinanol, nopol, isoborneol, carbeol, piperitol, thymol, alpha-terpineol, terpinen-4-ol, menthol, 1,8-terpin, dihydro- terpineol, nerol, geraniol, linalool, citronellol, hydroxycitronellol, 3, 7-dimethyl octanol, dihydromyrcenol, tetrahydro-alloocimenol, perillalcohol, and falcarindiol. Examples of suitable terpene ether and terpene ester solvents include 1,8-cineole, 1,4-cineole, isobornyl methylether, rose pyran, menthofuran, trans-anethole, methyl chavicol, allocimene diepoxide, limonene monoepoxide, isobornyl acetate, nonyl acetate, terpinyl acetate, linalyl acetate, geranyl acetate, citronellyl acetate, dihydroterpinyl acetate and meryl acetate. Further, examples of suitable terpene aldehyde and terpene ketone solvents include myrtenal, campholenic aldehyde, perillaldehyde, citronellal, citral, hydroxy citronellal, camphor, verbenone, carvenone, dihydro-carvone, carvone, piperitone, menthone, geranyl acetone, pseudo-ionone, ionine, iso-pseudo-methyl ionone, n-pseudo-methyl ionone, iso-methyl ionone and n-methyl ionone. The terpene derivatives may be present in the concentrate compositions in amounts of up to about 25% by weight, preferably in amounts of 0.1 and 15% by weight.

Essential oils include, but are not limited to, those obtained from thyme, lemongrass, citrus, lemons, oranges, anise, clove, aniseed, pine, cinnamon, geranium, roses, mint, lavender, citronella, eucalyptus, peppermint, camphor, sandalwood, rosmarin, vervain, fleagrass, lemongrass, ratanhiae, cedar and mixtures thereof. Preferred essential oils to be used herein are thyme oil, clove oil, cinnamon oil, geranium oil, eucalyptus oil, peppermint oil, mint oil or mixtures thereof.

Actives of essential oils to be used herein include, but are not limited to, thymol (present for example in thyme), eugenol (present for example in cinnamon and clove), menthol (present for example in mint), geraniol (present for example in geranium and rose), verbenone (present for example in vervain), eucalyptol and pinocarvone (present in eucalyptus), cedrol (present for example in cedar), anethol (present for example in anise), carvacrol, hinokitiol, berberine, ferulic acid, cinnamic acid, methyl salycilic acid, methyl salycilate, terpineol and mixtures thereof. Preferred actives of essential oils to be used herein are thymol, eugenol, verbenone, eucalyptol, terpineol, cinnamic acid, methyl salycilic acid, citric acid and/or geraniol.

Other essential oils include Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69.degree. C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobomyl acetate, Isolongifolene, Juniper berry oil, L-methhyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen. Each of these botanical oils is commercially available.

Particularly preferred oils include peppermint oil, lavender oil, bergamot oil (Italian), rosemary oil (Tunisian), and sweet orange oil. These may be commercially obtained from a variety of suppliers including: Givadan Roure Corp. (Clifton, N.J.); Berje Inc. (Bloomfield, N.J.); BBA Aroma Chemical Div. of Union Camp Corp. (Wayne, N.J.); Firmenich Inc. (Plainsboro N.J.); Quest International Fragrances Inc. (Mt. Olive Township, N.J.); Robertet Fragrances Inc. (Oakland, N.J.). The essential oils may be present in the concentrate compositions in amounts of up to about 25% by weight, preferably in amounts of 0.1 and 15% by weight.

Particularly useful lemon oil and d-limonene compositions which are useful in the invention include mixtures of terpene hydrocarbons obtained from the essence of oranges, e.g., cold-pressed orange terpenes and orange terpene oil phase ex fruit juice, and the mixture of terpene hydrocarbons expressed from lemons and grapefruit. The d-limonene and derivatives may be present in the concentrate compositions in amounts of up to about 25% by weight, preferably in amounts of 0.1 and 15% by weight.

Water

Since the composition is an aqueous composition, water can be, along with the solvent, a predominant ingredient. The water should be present at a level of less than 99.9%, more preferably less than about 99%, and most preferably, less than about 98%. Deionized water is preferred.

Method of Use

The dilutable cleaning compositions herein are preferably used by placing them in a container, such as a pan or bucket or reservoir in a cleaning device, with water, preferably pure, to form the dilute, usage compositions. The composition is preferably diluted and used with water in a ratio of 1:10 to 1:100 of the composition to water. However, it can also be used undiluted. The composition can be used with a cleaning implement, such as a mop, sponge, sprayer, hose sprayer attachment, or woven or non-woven substrate.

The compositions can be used for cleaning, disinfectancy, or sanitization on inanimate, household surfaces, including floors, counter tops, furniture, windows, walls, and automobiles. The compositions may be removed, after sufficient time has elapsed, by rinsing if pure water is available, or by absorption/wiping with an appropriate implement, e.g., paper towel, sponge, squeegee, etc. The compositions of this invention can also be used to treat/clean other inanimate household surfaces, such as fabrics, e.g., furniture, carpets, clothing, shoes, and shower curtains. The fabric can be treated totally, or by spot treatment, then the composition is preferably removed, at least partially, e.g., by rinsing, evaporation, draining, absorbency, and/or mechanical force.

Packaging the products herein in a container with instructions for usage in terms of timing and proper dilution in order to provide disinfectancy/sanitization, will help the individual consumer by providing information for proper dilution and/or usage in order to provide appropriate cleaning and/or flocculation of soil.

EXAMPLES

Flocculation Under Simulated Use Conditions

The flocculation under simulated use conditions was measured using a Turbidity Meter (VWR Scientific). The turbidity is measured as NTU units. Turn on the Turbidity Meter for 30 minutes for warm-up. Calibrate the Turbidity Meter using standard solutions. Mix 5 grams of cleaning solution to 320 grams of water (70° F., 30 ppm hardness as calcium carbonate). Let solution agitate (250-500 rpm on stir plate) until homogeneously mixed. Add 0.2 grams of bandy clay soil (Textile Innovation Corp) to the stirring solution and let mix for 30 seconds. Remove solution from stirring source and let sit for 30 seconds. Then decant the solution into the turbidity cell sample, place into Turbidity Meter, and read the turbidity after 90 seconds.

Tables 1-3 below list four dilutable base formulas to which the flocculation polymer was added. Table 4 shows that the flocculation polymer results in lower turbidity under simulated use conditions compared to four commercially available dilutable cleaners.

TABLE 1

| | Base A | Base B |
|---|---|---|
| Nonionic ethoxylate[a] | 8% | 8% |
| Triethanolamine | 3% | 3.5% |
| Isopropanol | 4% | |
| Maleic acid | | 0.07% |
| Lemon oils and fragrance | 0.9% | 0.7% |
| Water | Balance | Balance |
| pH | 9 | 9 |

[a]Surfonic L12-8 from Huntsman.

TABLE 2

| | Base C |
|---|---|
| Secondary alkane sulfonate, sodium salt[a] | 3.06% |
| Nonionic ethoxylate[b] | 4.29% |
| Benzoic Acid | 0.227% |
| Isopropanol | 2.85% |
| Pine Oil[c] | 9.3% |
| Glycolic Acid | 0.1% |
| Colorant | 0.05% |
| Water | Balance |

[a]Hostapur SAS 30 from Clariant.
[b]Genapol UD 070 from Clariant.
[c]Glidco 80 from SCM Glico Organics.

TABLE 3

| | Base D |
|---|---|
| Alkylbenzene sulfonic acid[a] | 2.88% |
| Alcohol ethoxysulfate, sodium salt[b] | 0.414% |
| Sodium alphaolefin sulfonate[c] | 1.2% |
| Nonionic ethoxylate[d] | 4.3% |
| Pine Oil[e] | 15% |
| Benzoic Acid | 0.4% |
| Caustic Soda | 0.3925% |
| IPA anhydrous | 5% |
| Ammonia | 0.012% |
| Glycolic Acid | 0.275% |
| Colorant | 0.03% |
| Water | Balance |
| pH | 3 |

[a]Biosoft S100 from Stepan Company.
[b]Neodol 25-3S from Shell Chemical.
[c]Bioterge AS-40 from Stepan Company.
[d]Surfonic L12-8 from Huntsman.
[e]SCM Glico Organics.

TABLE 4

| | Turbidity (Ntu) |
|---|---|
| Commercial Lemon Dilutable[a] | 100.7 |
| Commercial Lemon Dilutable[b] | 82.6 |
| Commercial Lemon Dilutable[c] | 106.5 |
| Commercial Lemon Dilutable[d] | 86.4 |
| Base B plus 0.02% polymer[e] | 28.8 |
| Base B plus 0.04% polymer[e] | 14.9 |
| Base B plus 0.06% polymer[e] | 13.3 |
| Base B plus 0.08% polymer[e] | 6.9 |
| Base A plus 0.08% polymer[e] | 14.7 |
| Base C plus 0.10% polymer[f] | 9.1 |
| Base D plus 0.10% polymer[f] | 8.1 |

[a]Advanced Grease Pine-Sol Lemon Fresh
[b]Lysol Lemon Breeze
[c]Mr. Clean Summer Citrus
[d]Lysol Pine
[e]FloGel 509 from SNF Floerger
[f]Polyox WSR-301 from Dow

Floc Weight Test

Direct measurements of weight of flocs by means of residue of evaporation are described as follows. Mix 5 grams of cleaning composition with 320 grams water for 30 seconds using stirring speed between 410-440 rpm. Add 0.5 grams of bandy clay (Textile Innovations Corp.) to the stirring solution and let stir for 30 seconds. Remove solution from stirring source and let sit for 30 seconds. Then, decant 270 grams of cleaning solution. Pour the rest of 50 grams solution plus soil into a pre-weighed sample cell. Place the sample into 80° C. oven for 5 hours. Weigh the sample cell and residue left behind. Repeat the procedure 3 times. To establish a control, mix the cleaning solution with ratio described above, decant 270 grams and pour the rest into a pre-weighed sample cell without adding any bandy clay.

The results in Table 5 show that the inventive compositions result in greater flocculation of the soil to the bottom of the cleaning mixture.

TABLE 5

| Composition | Residue minus control |
|---|---|
| Lysol Lemon | 0.18 g |
| Mr. Clean Lemon | 0.23 g |
| Lemon Fresh Pine-Sol | 0.13 g |
| Base B plus 0.02% polymer[a] | 0.44 g |
| Base B plus 0.08% polymer[a] | 0.49 g |

[a]FloGel 509 from SNF Floerger

The following are additional examples of the inventive composition. These compositions can be diluted and used with water in a ratio of 1:10 to 1:100 of the composition to water.

TABLE 6

| | Example 1 | Example 2 | Example 3 | Example 4 | Example 5 |
|---|---|---|---|---|---|
| Nonionic ethoxylate[a] | 8 | 8 | 8 | 8 | 10 |
| Monoethanolamine[b] | — | 3 | 3 | | 1 |
| Triethanolamine[c] | 4.7 | — | — | 3 | |
| Isopropanol[d] | 0 | 4 | — | 4 | |
| Tetrasodium EDTA[e] | — | — | 0.45 | | 0.2 |
| Maleic acid[f] | 0.1 | — | — | | |
| Lemon oils[g] | 0.7 | 0.9 | 0.3 | 0.9 | 2 |
| Fragrance | | 0.1 | 0.1 | | |
| Polymer[h] | 0.08 | 0.06 | 0.04 | 0.02 | 0.01 |
| Water | Balance | Balance | Balance | Balance | Balance |

[a]Surfonic L12-8 from Huntsman Corporation.
[b]Dow Chemical.
[c]Dow Chemical.
[d]BP Chemicals.
[e]Sigma Chemical Co.
[f]Huntsman Corporation.
[g]Lemon Fragrance Blend from Florachem.
[h]FO4190 from SNF Floerger.

-continued

| | Example 6 | Example 7 | Example 8 | Example 9 | Example 10 |
|---|---|---|---|---|---|
| Nonionic ethoxylate[a] | 6 | 5 | 8 | 5 | 5 |
| Amine oxide[b] | 0.25 | 0.25 | | | |
| Triethanolamine | 2 | 2 | | | |
| Diethyleneglycolbutyl ether[c] | 5 | 7 | | | |
| Isopropanol | | | | 6 | |
| Sodium Citrate[d] | 1 | 0.75 | 0.5 | | |
| Tetrasodium EDTA | | | | | 0.25 |
| Quat disinfectant[e] | 1 | 10 | | | 1.6 |
| Sodium cumeme sulfonate[f] | | | 3 | | |
| Alkyl sulfate[g] | | | 2.5 | 1 | |
| Sodium alkylbenzene sulfonate[h] | | | | 5 | |
| Sodium olefin sulfonate[i] | | | | 2 | |
| Tall oil fatty acid[j] | | | 0.3 | | |
| Amphoteric surfactant[k] | | | | | 4 |
| Pine oil[l] | | | 25 | 15 | |
| Fragrance | 0.7 | | | | 0.2 |
| Essential Oil[m] | | 2.0 | | | |
| Polymer[n] | 0.5 | 1.0 | 0.8 | 0.1 | 2.0 |
| Water | Balance | Balance | Balance | Balance | Balance |

[a]Neodol 25-7 from Shell Chemical.
[b]Barlox 14 from Lonza.
[c]Arco Chemical.
[d]Archer Daniels Midland Corporation
[e]BTC 8358 (alkyl dimethylbenzyl ammonium chloride) from Stepan Company.
[f]Witconate SCS from Witco Chemical.
[g]Stepanol WA from Stepan Company.
[h]Biosoft D-40 from Stepan Company.
[i]Bio-Terge AS-40 from Stepan Company.
[j]Hercules Inc.
[k]Amphoterge K-2 (disodium cocoamphodipropionate) from Lonza.
[l]Glidco Pine Oil 150 from Millenium Chemicals.
[m]Thymol from Mallinckrodt Baker Inc.
[n]Polyox WSR-301 from Dow Chemical.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

What is claimed is:

1. A method for cleaning hard or soft surfaces comprising the steps of:

a. diluting a cleaning composition with water in a ratio of 1:10 to 1:100 of the composition to water to obtain a diluted cleaning composition, wherein said cleaning composition comprises:

i. a polymer having a molecular weight of at least 2,000,000 which causes soil to flocculate when the composition is diluted and used with water in a ratio of 1:10 to 1:100 of the composition to water;

ii. a nonionic surfactant and an anionic surfactant; and iii. the remainder, water and/or minor ingredients;

b. applying said diluted cleaning composition to a surface with a cleaning device selected from the group consisting of a mop, a sponge, a squeegee, a towel or combinations thereof;

c. dipping said cleaning device in said diluted cleaning composition to gather additional cleaning solution, wherein the soil on said cleaning device flocculates in said diluted cleaning solution; and d. again applying said diluted cleaning composition, in which the soil has now flocculated, to a surface with said cleaning device.

2. The method according to claim 1, wherein said polymer is present at a level of 0.01-0.8% by weight.

3. The method according to claim 2, wherein said polymer is present at a level of 0.02-0.5% by weight.

4. The method according to claim 1, wherein said polymer is selected from the group consisting of polyacrylamide and copolymers, copolymers of polyacrylamide with acrylic acid, acrylic acid and copolymers, methacrylic acid and copolymers, polyethyleneimines, polyethylene oxide and copolymers, derivatives of a natural polymer, and combinations thereof.

5. The method according to claim 3, wherein said polymer is selected from the group consisting of polyacrylamide and copolymers, copolymers of polyacrylamide with acrylic acid, acrylic acid and copolymers, methacrylic acid and copolymers, polyethyleneimines, polyethylene oxide and copolymers, derivatives of a natural polymer, and combinations thereof.

6. The method according to claim 1, wherein the composition also contains an amphoteric surfactant.

7. The method according to claim 3, wherein the composition also contains an amphoteric surfactant.

8. The method according to claim 1, wherein the composition also contains a buffer and said buffer is selected from the group consisting of: monoethanolamine, monopropanolamine, diethanolamine, dipropanolamine, triethanolamine, 2-amino-2-methylpropanol, and mixtures thereof.

9. The method according to claim 1, wherein said composition additionally comprises an antimicrobial agent and said antimicrobial agent is present in the amount of 0.1 to 10%.

10. The method according to claim 1, wherein the turbidity under simulated use conditions is less than 50 NTU.

11. The method according to claim 10, wherein the turbidity under simulated use conditions is less than 30 NTU.

12. The method according to claim 1, wherein the flocculation under the floc weight test is greater than 0.25 g.

13. The method according to claim 12, wherein the flocculation under the floc weight test is greater than 0.30 g.

14. The method according to claim 13, wherein the flocculation under the floc weight test is greater than 0.35 g.

15. The method according to claim 3, wherein the turbidity under simulated use conditions is less than 50 NTU.

16. The method according to claim 15, wherein the turbidity under simulated use conditions is less than 30 NTU.

17. The method according to claim 3, wherein the flocculation under the floc weight test is greater than 0.25 g.

18. The method according to claim 17, wherein the flocculation under the floc weight test is greater than 0.30 g.

19. The method according to claim 18, wherein the flocculation under the floc weight test is greater than 0.35 g.

20. A method for cleaning hard or soft surfaces comprising the steps of:

a. diluting a cleaning composition with water in a ratio of 1:10 to 1:100 of the composition to water to obtain a diluted cleaning composition, wherein said cleaning composition comprises:

i. a polymer having a molecular weight of at least 2,000,000 which causes soil to flocculate when the composition is diluted and used with water in a ratio of 1:10 to 1:100 of the composition to water;

ii. a nonionic surfactant and an anionic surfactant; and iii. the remainder, water and/or minor ingredients;

b. repeatedly applying said diluted cleaning composition to a surface with a cleaning device selected from the group consisting of a mop, a sponge, a squeegee, a towel or combinations thereof c. repeatedly dipping said cleaning device into said diluted cleaning composition and gathering up more cleaning solution, wherein the soil contamination in the cleaning solution separates form the remaining cleaning solution.

* * * * *